US006755328B1

(12) United States Patent
Franco

(10) Patent No.: US 6,755,328 B1
(45) Date of Patent: Jun. 29, 2004

(54) MULTIPLE SPOUT PITCHER FOR POURING AN ICED BEVERAGE ALONE OR WITH ICE

(76) Inventor: Richard E. Franco, 121 SW. 5th Ct., Pompano Beach, FL (US) 33060

( * ) Notice: Subject to any disclaimer, the term of this patent is extended or adjusted under 35 U.S.C. 154(b) by 0 days.

(21) Appl. No.: 10/319,887

(22) Filed: Dec. 16, 2002

(51) Int. Cl.[7] ..... B67D 5/60

(52) U.S. Cl. ..... 222/465.1; 222/189.07; 222/478; 222/564; 222/566; 222/572

(58) Field of Search ..... 222/465.1, 189.07, 222/564, 566, 567, 571, 572, 478, 575, 475, 475.1; 220/703–704, 716–717, 719, 731, 711, 713

(56) References Cited

U.S. PATENT DOCUMENTS

| | | | | | |
|---|---|---|---|---|---|
| 1,104,490 | A | * | 7/1914 | Glazier | 222/572 |
| 1,925,913 | A | * | 9/1933 | Wood | 222/571 |
| 2,649,967 | A | | 8/1953 | Tyson | |
| 2,815,155 | A | | 12/1957 | Roche | |
| 187,940 | A | | 5/1960 | Hughes | |
| D221,168 | S | * | 7/1971 | Benes | D36/2 |
| 3,599,846 | A | * | 8/1971 | Stephenson | 222/553 |
| 3,700,146 | A | * | 10/1972 | Cousins et al. | 222/465.1 |
| 3,861,565 | A | * | 1/1975 | Rickmeier | 222/131 |
| 4,492,323 | A | | 1/1985 | Essem | |
| 4,957,224 | A | | 9/1990 | Kessler et al. | |
| 5,246,149 | A | * | 9/1993 | Broitzman | 222/465.1 |
| 5,275,307 | A | * | 1/1994 | Freese | 222/42 |
| 5,289,953 | A | | 3/1994 | McMillan, III et al. | |
| 5,845,807 | A | * | 12/1998 | De Villiers | 220/703 |

FOREIGN PATENT DOCUMENTS

| | | | | |
|---|---|---|---|---|
| DE | 3408449 | A1 * | 9/1985 | A47G/19/12 |

* cited by examiner

*Primary Examiner*—Richard E. Franco
*Assistant Examiner*—Frederick Nicolas
(74) *Attorney, Agent, or Firm*—Oltman, Flynn & Kubler

(57) ABSTRACT

A multiple spout pitcher which allows selectively pouring a beverage alone or the beverage and ice contained therein. The pitcher includes a bottom wall and upwardly dependent side wall which terminates at an open upper rim. A handle extends outwardly from the side wall to facilitate picking up the pitcher container by hand. An ice restricting spout is formed outwardly from the side wall at the upper rim opposite the handle. The ice restricting spout includes a pair of opposing inwardly extending restrictor flaps to hold the ice back without unduly restricting the flow of beverage while pouring. A larger and wider ice passing spout is formed outwardly from the side wall at the upper rim between the handle and the ice restricting spout which allows the ice as well as the beverage to pour. The pitcher may be constructed with the ice passing spout disposed to the left or the right of the handle as desired for use by right-handed or left-handed persons. A second ice passing spout may be included to facilitate use by both right-handed and left-handed persons.

22 Claims, 6 Drawing Sheets

MULTIPLE SPOUT PITCHER FOR POURING AN ICED BEVERAGE ALONE OR WITH ICE

BACKGROUND OF THE INVENTION

1. Field of the Invention

The present invention relates generally to the field of pitchers for serving iced beverages such as water, fruit juices, and soft drinks by pouring into individual smaller drinking containers such as glasses for consumption by persons. More specifically the present invention relates to a multiple spout pitcher for containing the beverage and ice floating in the beverage which allows selectively pouring the beverage alone or the beverage and ice contained therein into the drinking containers. The pitcher includes a side wall that is upwardly dependent from a bottom wall, the side wall terminating at an upper rim which defines an upper opening and an inner chamber. An ice restricting spout is formed radially outwardly from the side wall at the upper rim. The ice restricting spout has a restrictor to hold the ice back and keep the ice from exiting from the inner chamber while pouring the beverage. An ice passing spout is formed radially outwardly from the side wall disposed about ninety-degrees from the ice restricting spout at the upper rim which allows the ice as well as the beverage to exit simultaneously from within the inner chamber.

The preferred pitcher includes a handle which extends radially outwardly from the side wall diametrically opposite the ice restricting spout to facilitate picking up the pitcher container by hand. The ice passing spout and the ice restricting spout are each of an upwardly open, rounded V-shaped cross-section. The restrictor comprises a pair of oppositely disposed, inwardly extending restrictor flaps which extend inwardly at an upward angle. The ice passing spout is larger and wider than the ice restricting spout, being disposed about ninety-degrees to the left of the handle as held in-hand for right-handed persons and disposed about ninety degrees to the right of the handle as held in-hand for left-handed persons. A second ice passing spout may be disposed diametrically opposite the ice passing spout disposed about ninety-degrees to the left and right of the handle to facilitate use by both right-handed and left-handed persons. The bottom wall, the side wall, and the handle are integrally molded together.

2. Description of the Prior Art

Beverages such as water, lemonade, fruit punch, soft drinks, and the like are commonly served from open topped pitchers and pitchers that are closeable by an pivoting attached lid or a removable lid. Open topped pitchers typically include a body comprised of a bottom wall and upwardly dependent wall of a cylindrical or other configuration having a top rim which defines an upper opening of an inner chamber thereof to contain a beverage with or without ice. The pitcher includes an outwardly extending handle for gripping in-hand and an outwardly projecting pouring spout disposed diametrically opposite the handle. The pouring spout directs the beverage from within the pitcher into a drinking glass or other individual serving container. Other pitchers have a lipless pouring spout comprising an outlet opening which does not direct the beverage from within the pitcher into the drinking glass. Many beverages are iced by having a plurality of ice cubes floating therein. It is desirable to have a pitcher which permits selectively pouring of the beverage along with ice cubes, or the beverage alone with the ice cubes remaining within the pitcher. Therefore, pitchers which have ice restricting pouring spouts or with ice barriers disposed ahead of the pouring spout have been developed.

The ice restricting pouring spouts may include a restrictor incorporated into the pouring spout to restrict the outward flow of ice. The ice restricting pouring spout is typically disposed diametrically opposite a handle extending outwardly from the pitcher to facilitate pouring by both left-handed and right-handed persons. When desired to pour both the beverage and ice, the server typically must pour the beverage and ice over the non-spouted sides of the pitcher. This results in an uncontrolled flow of the beverage into the drinking glass with considerable spillage outside the drinking glass.

An ideal pitcher containing a beverage with floating ice would provide the server the choice of pouring the beverage alone, without ice, or the beverage with ice depending on the desire of the person being served the beverage. Various pitchers have thus been developed in an attempt to provide such a choice. For example, a multi-spouted serving pitcher is disclosed in Kessler et al., U.S. Pat. No. 4,957,224 issued on Sep. 18, 1990. The pitcher includes a shell body having a base at one end and a vertical shell wall with an open upper edge at an opposite end. An inwardly disposed spill guard at the upper edge facilitates spill-resistant serving of a beverage contained in the pitcher by retaining splashing and sloshing of the contained beverage. One portion of the upper edge of the shell wall is shaped to define an outwardly projecting pouring spout that is covered by the spill guard except for a triangular pouring hole through which the beverage may be poured, but which restricts the flow of ice cubes. The shell wall is extended outwardly from the remainder of the shell body and angled downwardly from the plane of the remaining spoutless portion of the upper edge. At least one outlet opening is defined by a notch in the rim of the spill guard positioned transverse to the pouring spout. A handle is disposed on the exterior of the shell body opposite the pouring spout. An auxiliary hand grip comprises a plurality of raised vertical ribs disposed on the exterior surface of the shell body. The pitcher provides a choice of restricted ice-free liquid delivery from the pouring spout and free flowing iced liquid delivery from the outlet opening.

The pitcher disclosed in Kessler et al. has several disadvantages. Firstly, the triangular pouring hole of the pouring spout blocks the flow of the beverage along with the ice cubes, causing the beverage to be directed in undesired directions and spillage. Secondly, the outlet opening does not permit sufficient directional flow of the beverage and ice cubes due to the lack of a pouring spout. Finally, the pitcher is difficult to properly clean due to the inwardly disposed spill guard which obstructs the entrance to the inner chamber for cleaning the interior thereof.

Another attempt to provide a pitcher which gives the server the option of pouring the beverage alone or the beverage with ice is McMillan, III, et al., U.S. Pat. No. 5,289,953 issued on Mar. 1, 1994. McMillan, III, et al. reveals a pitcher having a projecting front spout for the pouring of the beverage contained therein disposed near the base of the pitcher, and two side chutes for the pouring of a combination of the beverage and ice. The pitcher comprises a bottom wall and a side wall extending upwardly from the bottom wall having a top edge. A handle extends outwardly from the side wall. A first elongate chute tapers outwardly from the side wall opposite the handle, starting at the bottom wall and extending to the top edge and terminating at a downwardly angled, outlet opening. The first chute has a removable strainer plate having a plurality of lower slots which permits the beverage but not the ice to flow through, being slidably mounted in a pair of longitudinal grooves extending downwardly from the top edge for preventing ice cubes floating in the beverage contained in the pitcher from entering the first chute. A second elongate chute tapers outwardly from the side wall between the handle and the first chute, starting at the bottom wall and extending to the top edge and terminating at a downwardly angled, outlet opening. The second chute has a size and shape for aligning a series of the ice cubes as the pitcher is tilted, dispensing the beverage and ice cubes together from the second chute. It is stated that the pitcher permits the beverage alone without ice cubes may be poured from the first chute, and the beverage with ice cubes may be poured from the second chute.

The pitcher disclosed in McMillan, III, et al. also has several disadvantages. Firstly, the first chute is prone to blockage unless ice cubes of a uniform, predetermined size are used such that a linear progression of the ice cubes is maintained within the first chute. Otherwise, the flow of the beverage is either completely blocked, or partially blocked causing the beverage to be directed in undesired directions and spillage. Secondly, the downwardly angled, outlet openings do not permit sufficient directional flow of the beverage alone or the beverage with ice cubes due to the lack of a pouring spout. Thirdly, the pitcher is more difficult and expensive to mold than necessary due to the use of the chutes, and the removable strainer which must be separately molded and the pitcher be molded with the sliding grooves. Finally, the pitcher is difficult to properly clean due to the convoluted interior shape and dirt-accumulating right-angle edges thereof.

There is a need for a multiple spout pitcher for containing a beverage and ice floating in the beverage which allows selectively pouring the beverage alone or the beverage and ice contained therein into a smaller drinking container which 1) has an ice restricting spout that does not unduly block the flow of the beverage along with the ice cubes; 2) has an ice restricting spout and a ice passing spout that permit good directional flow of the respective beverage alone or the beverage with ice cubes regardless of the uniformity and size of the ice cubes; 3) that is designed with a mostly uniform cross-section which is easy and inexpensive to mold, comprising a single unitary piece rather than multiple pieces which must be separately molded and assembled together; and 4) that is readily cleanable, having an unobstructed access to the inner chamber and a non-convoluted interior shape with no dirt-accumulating right-angle edges or sliding grooves.

It is thus an object of the present invention to provide a multiple spout pitcher that has an ice restricting spout which does not unduly block the flow of the beverage along with the ice cubes.

It is another object of the present invention to provide a multiple spout pitcher that has an ice restricting spout and a ice passing spout that permit good directional flow of the respective beverage alone or the beverage with ice cubes regardless of the uniformity and size of the ice cubes.

It is a still further object of the present invention to provide a multiple spout pitcher that is designed with a mostly uniform cross-section which is easy and inexpensive to mold, comprising a single unitary piece rather than multiple pieces which must be separately molded and assembled together.

It is still another object of the present invention to provide such a multiple spout pitcher that is readily cleanable, having an unobstructed access to the inner chamber and a non-convoluted interior shape with no dirt-accumulating right-angle edges or sliding grooves.

It is finally an object of the present invention to provide such a multiple spout pitcher that is equally useable by both left-handed and right-handed persons.

SUMMARY OF THE INVENTION

The present invention accomplishes the above-stated objectives, as well as others, as may be determined by a fair reading and interpretation of the entire specification.

A multiple spout pitcher is provided for containing a beverage and ice floating in the beverage which allows selectively pouring the beverage alone or the beverage and ice contained therein into a smaller drinking container including a bottom wall defining a bottom plane for placement on a flat support surface, at least one side wall upwardly dependent from the bottom wall terminating at an upper rim which defines an upper opening and an inner chamber, an ice restricting spout formed radially outwardly from the side wall at the upper rim and having a restrictor to hold the ice back and keep the ice from exiting from the inner chamber while pouring the beverage, and an ice passing spout formed radially outwardly from the side wall at the upper rim and adapted to allow the ice as well as the beverage to exit simultaneously from within the inner chamber.

The pitcher preferably has a single cylindrical side wall upwardly dependent from the bottom wall, the bottom wall, the upper rim, and the upper opening being circular, and the inner chamber being cylindrical. The bottom wall is substantially flat, and the cylindrical side wall is upwardly dependent from an outer periphery of the bottom wall. A handle extends radially outwardly from the side wall to facilitate picking up the pitcher container by hand. The bottom wall, the side wall, and the handle are integrally molded together. The ice passing spout and the ice restricting spout are each of an upwardly open, rounded V-shaped cross-section. The ice restricting spout is disposed diametrically opposite the handle with the restrictor comprising a pair of oppositely disposed, inwardly extending restrictor flaps which extend inwardly at an upward angle. The ice passing spout is larger and wider than the ice restricting spout, disposed about ninety-degrees to the left of the handle as held in-hand for right-handed persons and disposed about ninety degrees to the right of the handle as held in-hand for left-handed persons. A second ice passing spout may be disposed diametrically opposite the ice passing spout disposed about ninety-degrees to the left and right of the handle to facilitate use by both right-handed and left-handed persons.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
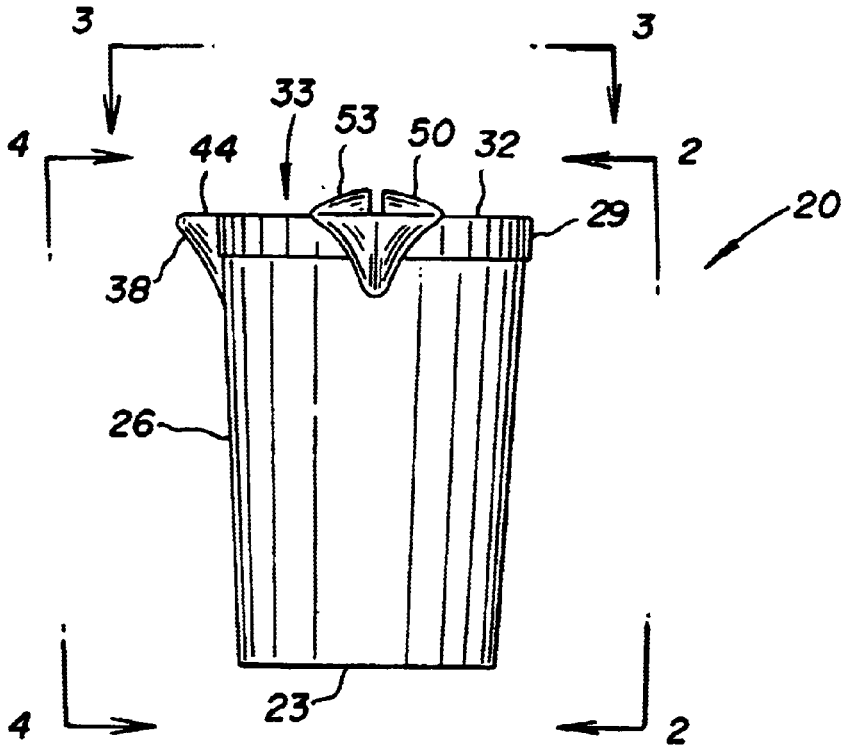
FIG. 1 is a front elevational view of a first preferred embodiment multiple spout pitcher which is designed for use by left-handed persons, showing the flat circular bottom wall and upstanding cylindrical side wall at the outer periphery thereof, the ice restricting spout and the ice passing spout disposed at ninety degrees thereto extending from the side wall.
Figure 2:
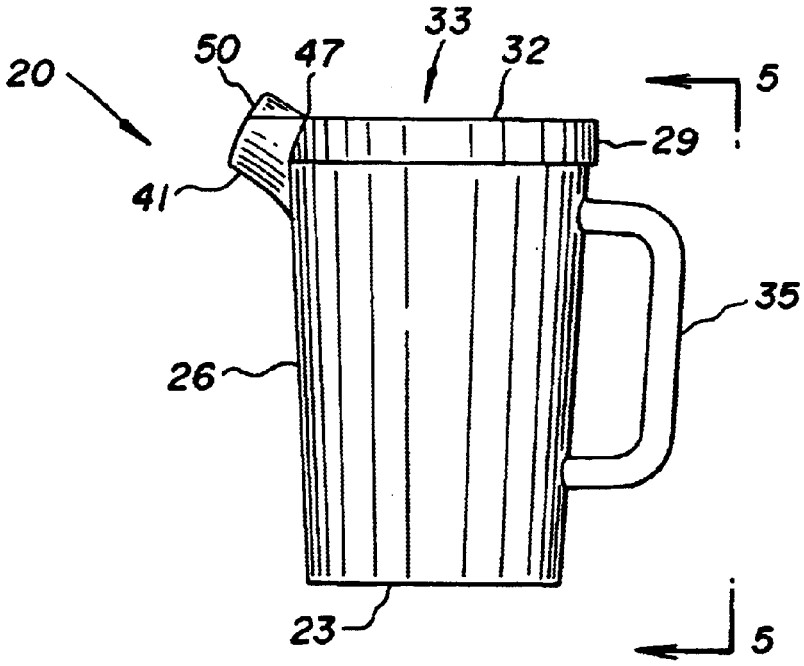
FIG. 2 is a right side elevational view of the multiple spout pitcher taken on the line 2—2 of FIG. 1, showing the elongate U-shaped handle disposed diametrically opposite the ice restricting spout.
Figure 3:
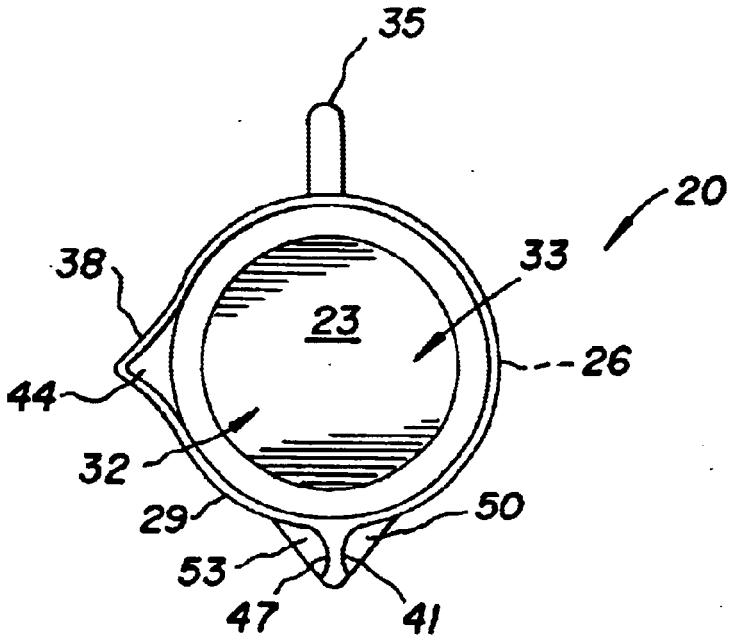
FIG. 3 is a top plan view of the multiple spout pitcher taken on the line 3—3 of FIG. 1, showing the inwardly extending restrictor flaps of the ice restricting spout, and the upwardly open, rounded V-shaped cross-section of ice passing spout and the ice restricting spout.
Figure 4:
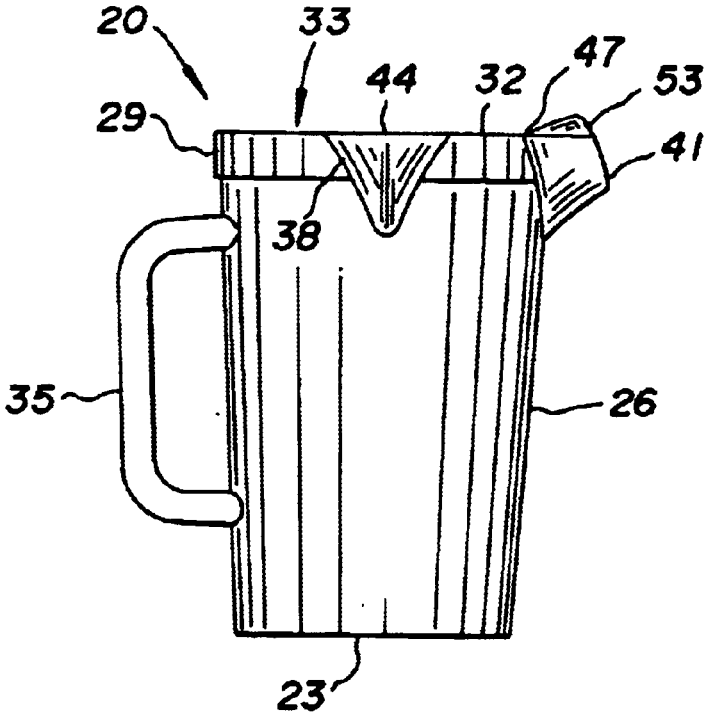
FIG. 4 is a left side elevational view of the multiple spout pitcher taken on the line 4—4 of FIG. 1, showing the elongate U-shaped handle disposed diametrically opposite the ice restricting spout, and the ice pouring spout disposed ninety degrees therebetween.
Figure 5:
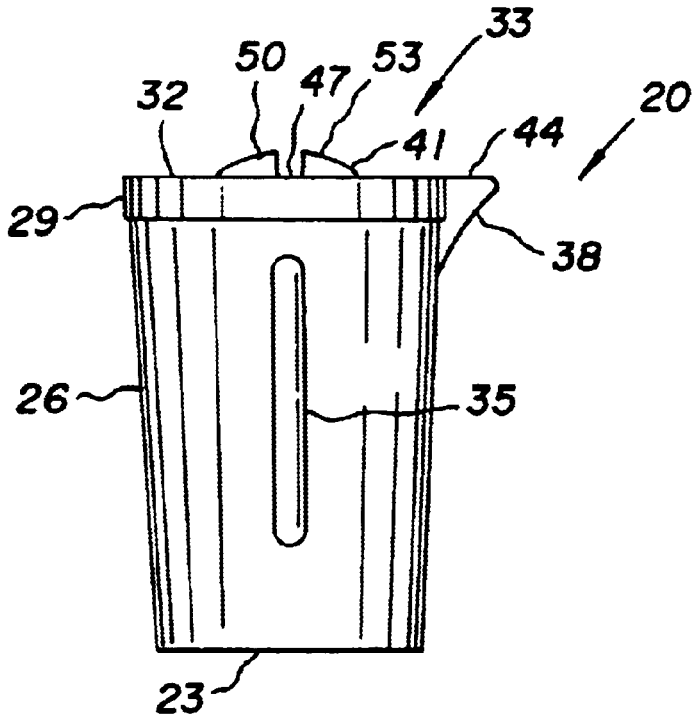
FIG. 5 is a rear elevational view of the multiple spout pitcher taken on the line 5—5 of FIG. 2, showing the elongate U-shaped handle and the ice pouring spout disposed ninety degrees therefrom.

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–5, a first preferred embodiment multiple spout pitcher 20 for containing a beverage and ice floating in the beverage (not shown) which allows selectively pouring the beverage alone or the beverage and ice contained therein into a smaller drinking container which is designed for use by left-handed persons is disclosed. A "pitcher" for purposes of this application is understood to be pouring containers that are designed to pour iced beverages containing ice therein including beverage pitchers and receptacles, with or without handles, and with or without movable lids, such as water pitchers, carafes, and other hand-held beverage pouring containers.

The pitcher 20 includes a flat, circular bottom wall 23 defining a bottom plane for placement on a flat support surface (not shown), and an integral upstanding cylindrical side wall 26 upwardly dependent from the bottom wall 23 at an outer periphery thereof terminating at an upper rim 29 which defines an upper opening 32 and an inner chamber 33. The bottom wall 23, the upper rim 29, and the upper opening 32 are circular with the inner chamber 33 being cylindrical. A U-shaped handle 35 extends radially outwardly from the side wall 26, the handle 35 being of a vertically elongate U-shape extending longitudinally along the side wall 26 to facilitate picking up pitcher 20 by hand. An ice passing spout 38 and an ice restricting spout 41 are formed radially outwardly from the side wall 26 at the upper rim 29. The ice passing spout 38 is preferably larger and wider than the ice restricting spout 41 to facilitate the passing of ice cubes therethrough. The bottom wall 23, the side wall 26, and the handle 35 are preferably integrally molded together.

The ice passing spout 38 is disposed ninety-degrees to the right of the handle 35 for pouring water and ice from within pitcher 20 through a spout opening portion 44 of the upper opening 32 into a water glass (not shown). The ice passing spout 38 is of an upwardly open, rounded V-shaped cross-section which allows the ice as well as the beverage to exit simultaneously from within the inner chamber 33. The placement of the ice passing spout 38 to the right of the handle 35 as held in a left-handed person's left hand (not shown) permits pouring of water by left-handed persons inwardly to the right.

The ice restricting spout 41 is disposed diametrically opposite the handle 35 for pouring only water from within pitcher 20 through a spout opening portion 47 of the upper opening 32 into the water glass while stopping ice from passing therethrough into the water glass for persons whom do not want ice in their water. The ice restricting spout 41 is of an upwardly open, rounded V-shaped cross-section similar to the ice passing spout 38, but having a restrictor to hold the ice back and keep the ice from exiting from the inner chamber 33 while pouring the beverage in the form of a pair of oppositely disposed restrictor flaps 50 and 53 that extend inwardly at an upward angle which block the movement of ice cubes through the spout opening portion 47 while permitting water to flow. The placement of the ice restricting spout 41 opposite the handle 35 permits pouring of water by both left-handed and right-handed persons.

The features of the pitcher 20, as well as for the corresponding parts of the subsequently described embodiments include that the ice restricting spout 41 does not unduly block the flow of the beverage along with the ice cubes. This is due to the elongate configuration of the restrictor flaps 50 and 53 which allows the ice cubes to move along an open-ended slot formed therebetween and not fixedly bunch-up while pouring the beverage. The ice restricting spout 41 and the ice passing spout 38 respectively permit good directional flow of the beverage alone and the beverage with ice cubes regardless of the uniformity and size of the ice cubes. This is due to the upwardly open, rounded V-shaped cross-section of each spout which smoothly guides the flow to the respective tip thereof. The pitcher 20 is designed with a mostly uniform cylindrical cross-section which is easy and inexpensive to mold, comprising a single unitary piece. The pitcher 20 is readily cleanable, having an unobstructed access to the inner chamber 33 and a non-convoluted interior shape with no dirt-accumulating right-angle edges or sliding grooves.

Second Preferred Embodiment

Figure 6:
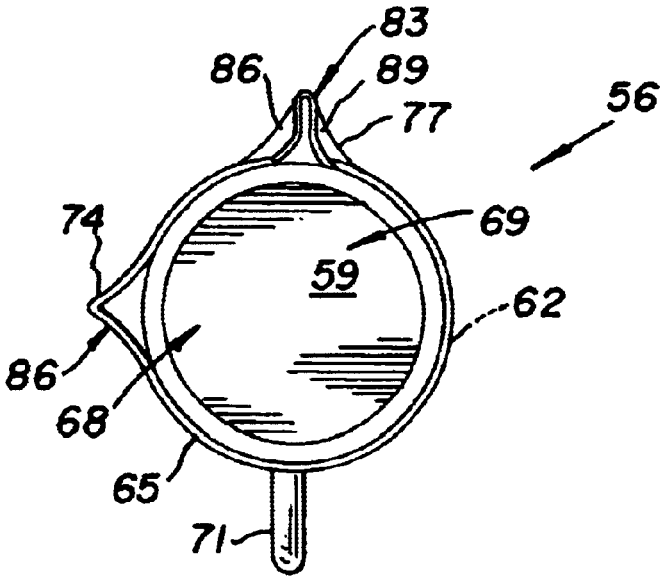
FIG. 6 is a top plan view of a second preferred embodiment multiple spout pitcher which is designed for use by right-handed persons, showing the flat circular bottom wall and upstanding cylindrical side wall at the outer periphery thereof, the ice restricting spout and the ice passing spout disposed at ninety degrees thereto extending from the side wall.
Figure 7:
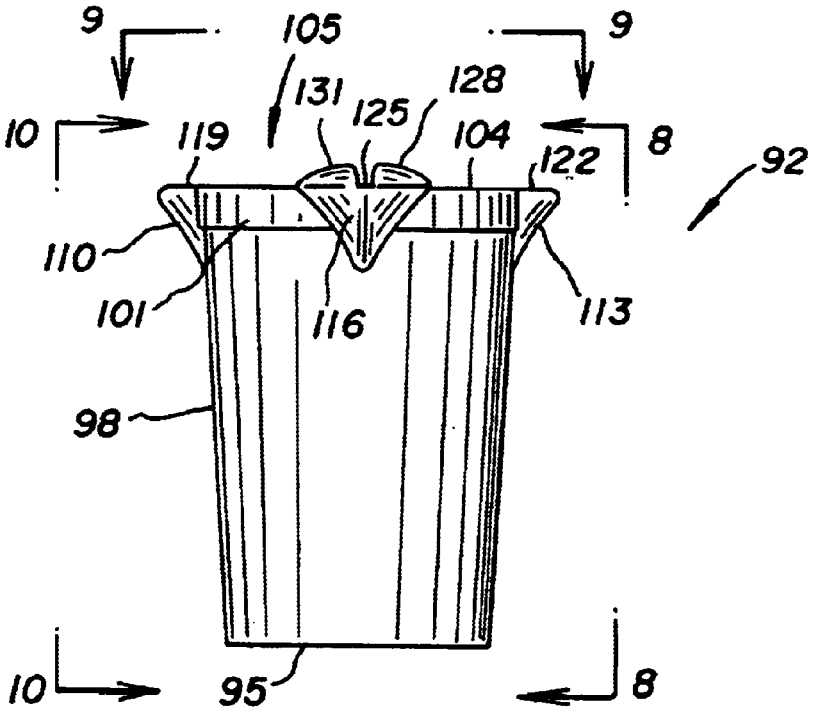
FIG. 7 is a front elevational view of a third preferred embodiment multiple spout pitcher which is designed for both left-handed and right-handed persons, showing the flat circular bottom wall and upstanding cylindrical side wall at the outer periphery thereof, the ice restricting spout and a pair of the ice passing spouts extending from the side wall, the ice passing spouts being diametrically oppositely disposed and each disposed at ninety degrees to the ice restricting spout.
Figure 10:
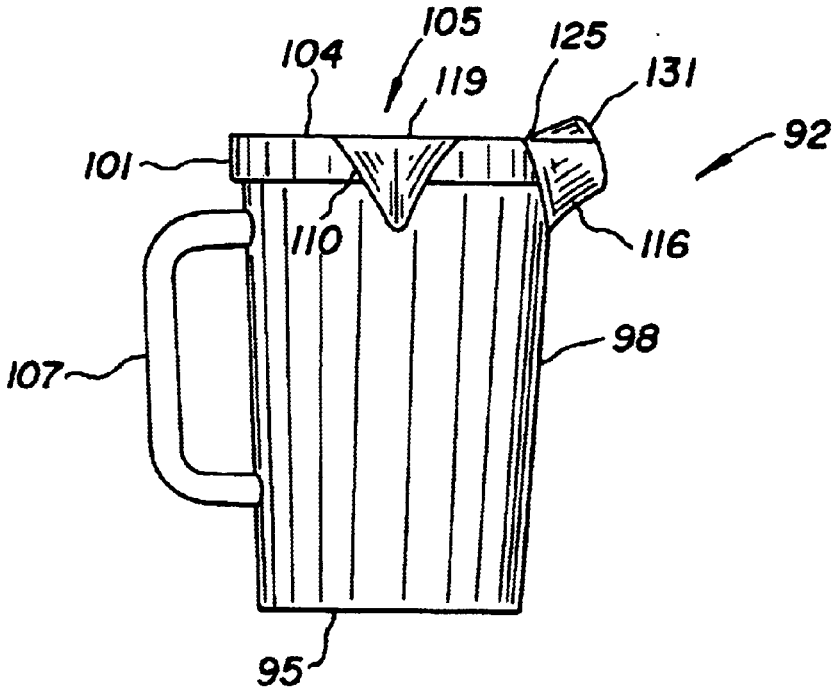
FIG. 10 is a left side elevational view of the multiple spout pitcher taken on the line 10—10 of FIG. 7, showing the elongate U-shaped handle disposed diametrically opposite the ice restricting spout, and the ice pouring spouts disposed ninety degrees therebetween.
Figure 8:
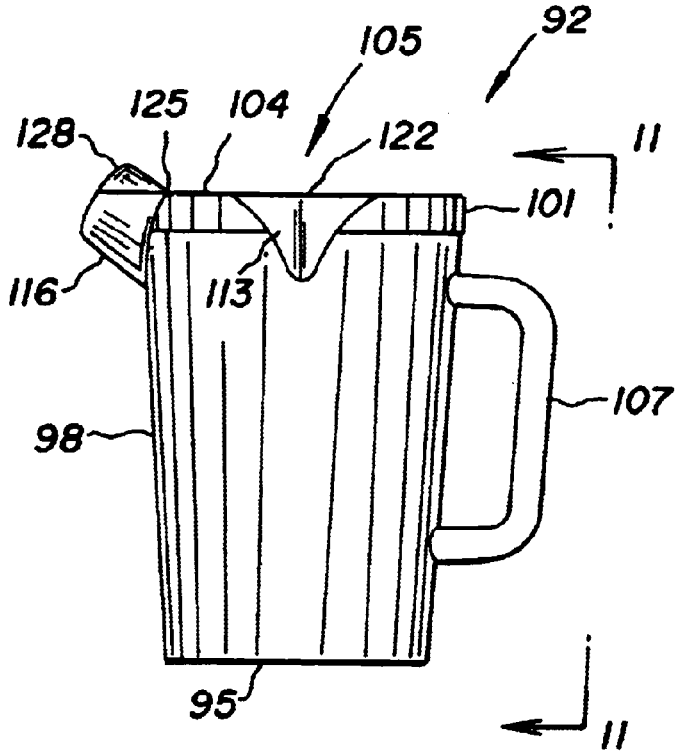
FIG. 8 is a right side elevational view of the multiple spout pitcher taken on the line 8—8 of FIG. 7, showing the elongate U-shaped handle disposed diametrically opposite the ice restricting spout.
Figure 9:
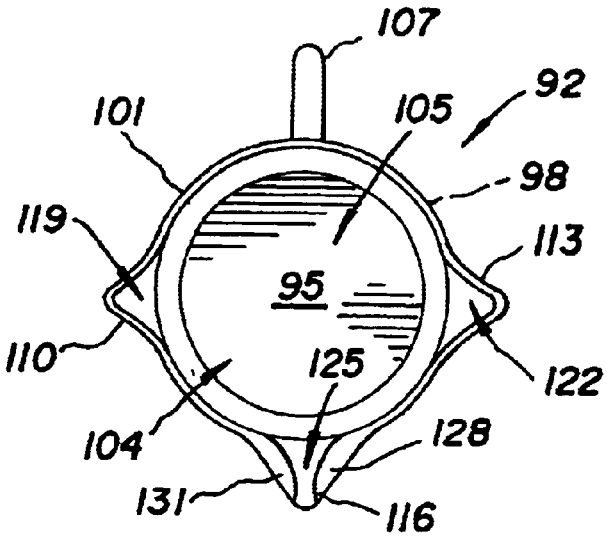
FIG. 9 is a top plan view of the multiple spout pitcher taken on the line 9—9 of FIG. 7, showing the inwardly extending restrictor flaps of the ice restricting spout, and the upwardly open, rounded V-shaped cross-section of ice passing spouts and the ice restricting spout.
Figure 11:
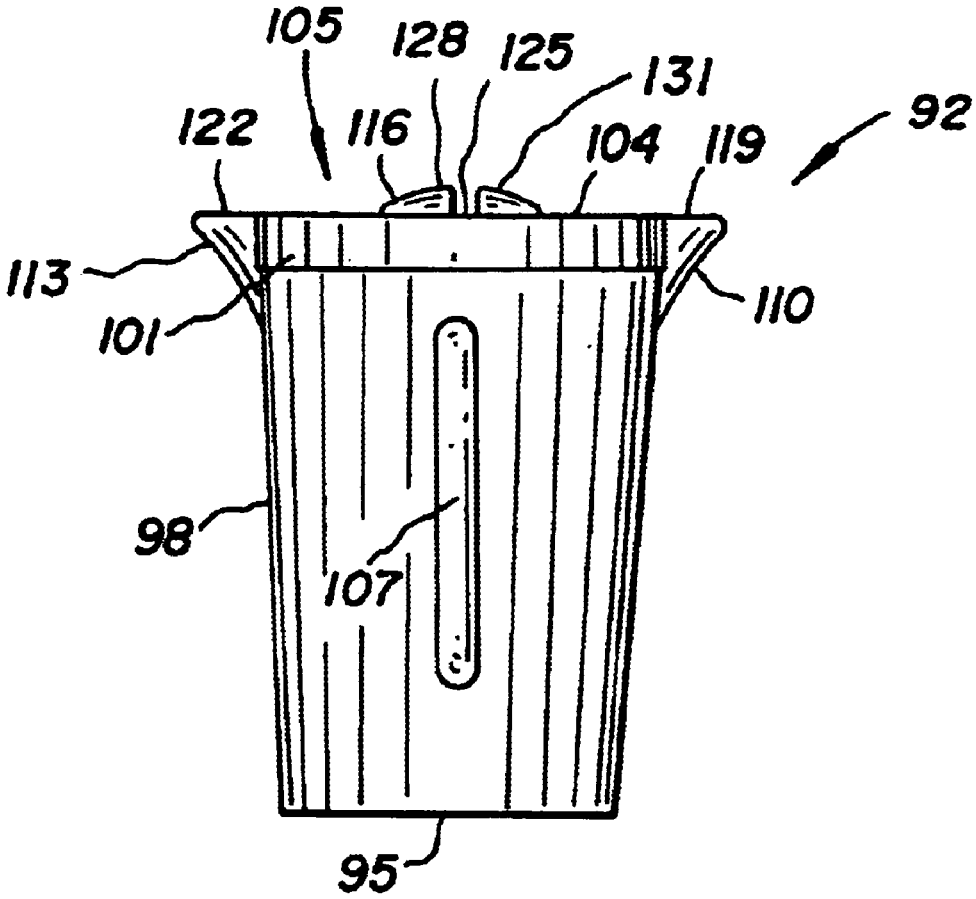
FIG. 11 is a rear elevational view of the multiple spout pitcher taken on the line 11—11 of FIG. 8, showing the elongate U-shaped handle and the ice pouring spout disposed ninety degrees therefrom.

Referring to FIG. 6, a second preferred embodiment multiple spout pitcher 56 for containing a beverage and ice floating in the beverage (not shown) which allows selectively pouring the beverage alone or the beverage and ice contained therein into a smaller drinking container which is designed for use by right-handed persons is disclosed.

The pitcher 56 is identical to the pitcher 20 but is a mirror image thereof, including a flat, circular bottom wall 59 defining a bottom plane for placement on a flat support surface (not shown), and an integral upstanding cylindrical side wall 62 at an outer periphery thereof terminating at an upper rim 65 which defines an upper opening 68 and an inner chamber 69. The bottom wall 59, the upper rim 65, and the upper opening 68 are circular with the inner chamber 69 being cylindrical. A U-shaped handle 71 extends radially outwardly from the side wall 62, the handle 71 being of a vertically elongate U-shape extending longitudinally along the side wall 62 to facilitate picking up pitcher 56 by hand. An ice passing spout 74 of the same configuration as ice pouring spout 38 and an ice restricting spout 77 of the same configuration as the ice restricting spout 41 are formed radially outwardly from the side wall 62 at the upper rim 65. The ice passing spout 74 is preferably larger and wider than the ice restricting spout 77 to facilitate the passing of ice cubes therethrough. The bottom wall 59, the side wall 62, and the handle 71 are preferably integrally molded together.

The ice passing spout 74 is disposed ninety-degrees to the left of the handle 71 for pouring water and ice from within pitcher 56 through a spout opening portion 80 of the upper opening 68 into the water glass. The ice passing spout 74 is of an upwardly open, rounded V-shaped cross-section which allows the ice as well as the beverage to exit simultaneously from within the inner chamber 69. The placement of the ice passing spout 74 to the left of the handle 71 as held in a right-handed person's right hand (not shown) permits pouring of water by right-handed persons inwardly to the left.

The ice restricting spout 77 is disposed diametrically opposite the handle 71 for pouring only water from within pitcher 56 through a spout opening portion 83 of the upper opening 68 into the water glass while stopping ice from passing therethrough into the water glass for persons whom do not want ice in their water. The ice restricting spout 77 is of an upwardly open, rounded V-shaped cross-section similar to the ice passing spout 74, but having a restrictor to hold the ice back and keep the ice from exiting from the inner chamber 69 while pouring the beverage in the form of a pair of oppositely disposed restrictor flaps 86 and 89 that extend inwardly at an upward angle which block the movement of ice cubes through the spout opening portion 83, while permitting water to flow. The placement of the ice restricting spout 77 opposite the handle 71 permits pouring of water by both left-handed and right-handed persons.

Third Preferred Embodiment

Referring to FIGS. 7–11, a third preferred embodiment multiple spout pitcher 92 for containing a beverage and ice floating in the beverage (not shown) which allows selectively pouring the beverage alone or the beverage and ice contained therein into a smaller drinking container which is designed for use by both left-handed and right-handed persons is disclosed.

The pitcher 92 is a combination of the pitchers 20 and 56, including a flat, circular bottom wall 95 defining a bottom plane for placement on a flat support surface (not shown), and an integral upstanding cylindrical side wall 98 at an outer periphery thereof terminating at an upper rim 101 which defines an upper opening 104 and an inner chamber 105. The bottom wall 95, the upper rim 101, and the upper opening 104 are circular with the inner chamber 105 being cylindrical. A U-shaped handle 107 extends radially outwardly from the side wall 98, the handle 107 being of a vertically elongate U-shape extending longitudinally along the side wall 98 to facilitate picking up pitcher 92 by hand. A pair of diametrically oppositely disposed ice passing spouts 110 and 113 of the same configuration as ice pouring spouts 38 and 74, and an ice restricting spout 116 of the same configuration as the ice restricting spouts 41 and 77 are formed radially outwardly from the side wall 98 at the upper rim 101. The ice passing spouts 110 and 113 are preferably larger and wider than the ice restricting spout 116 to facilitate the passing of ice cubes therethrough. The bottom wall 95, the side wall 98, and the handle 107 are preferably integrally molded together.

The ice passing spouts 110 and 113 are respectively disposed ninety-degrees to the left and the right of the handle 107 for pouring water and ice from within pitcher 92 through respective spout opening portions 119 and 122 of the upper opening 104 into the water glass. The ice passing spouts 110 and 113 are of an upwardly open, rounded V-shaped cross-section which allows the ice as well as the beverage to exit simultaneously from within the inner chamber 105. The placement of the ice passing spouts 110 and 113 to the left and right of the handle 107 as held in a left-handed or right-handed person's left or right hand permits pouring of water by both left-handed and right-handed persons inwardly to the left or right.

The ice restricting spout 116 is disposed diametrically opposite the handle 107 for pouring only water from within pitcher 92 through a spout opening portion 125 of the upper opening 104 into the water glass while stopping ice from passing therethrough into the water glass for persons whom do not want ice in their water. The ice restricting spout 116 is of an upwardly open, rounded V-shaped cross-section similar to the ice passing spouts 110 and 113, but having a restrictor to hold the ice back and keep the ice from exiting from the inner chamber 105 while pouring the beverage in the form of a pair of oppositely disposed restrictor flaps 128 and 131 that extend inwardly at an upward angle which block the movement of ice cubes through the spout opening portion 125 while permitting water to flow. The placement of the ice restricting spout 116 opposite the handle 107 permits pouring of water by both left-handed and right-handed persons.

The pitchers of the present invention may be constructed from any non-toxic moldable plastic material such as polypropylene, polyethylene, polyvinyl chloride, polyethylene terephthalate (PET), acrylic plastic, polycarbonates, acrylic plastics, and the like using any of a number of manufacturing processes such as blow molding, injection molding, casting, and the like. Likewise, other non-plastic materials such as glass, aluminum, an stainless steel may be used utilizing appropriate manufacturing processes.

Many variations to the multiple spout pitcher of the present invention are possible while staying within the same inventive concept. For example, the beverage holding capacity and the cross-sectional shape of the pitcher may be varied from cylindrical, such as rectangular or polygonal. The shape and angle of the ice restricting spout and the ice passing spout as well as the configuration of the restrictor flaps may be altered while accomplishing the stated objectives. The handle may be omitted for pitchers that are narrow enough to be gripped directly in-hand, such as wherein the pitcher is non-circular shape as oval shaped, oblong, or rectangular shaped. Horizontal or vertical indents in the side wall may be added to facilitate gripping in-hand without slippage. The size and shape of the handle may be varied from the U-shape shown so long as it is strong enough to support the weight of the pitcher filled with a beverage and ice cubes. The exterior of the pitcher may be chrome-plated or otherwise finished to provide the desired appearance. The ice passing spouts may be disposed other than exactly radially between the handle and the ice restricting spout as desired.

The multiple spout pitcher of the present invention thus meets the aforementioned objectives by providing such a pitcher having an ice restricting spout which does not unduly block the flow of the beverage along with the ice cubes. The pitcher that has an ice restricting spout and a ice passing spout which permit good directional flow of the respective beverage alone or the beverage with ice cubes regardless of the uniformity and size of the ice cubes. The pitcher is designed with a mostly uniform cross-section which is easy and inexpensive to mold, comprising a single unitary piece rather than multiple pieces which must be separately molded and assembled together. The pitcher is readily cleanable, having an unobstructed access to the inner chamber and a non-convoluted interior shape with no dirt-accumulating right-angle edges or sliding grooves. The pitcher is equally useable by both left-handed and right-handed persons.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teaching herein are particularly reversed especially as they fall within the breadth and scope of the claims here appended.

I claim as my invention:

1. A multiple spout pitcher for containing a beverage and ice floating in the beverage which allows selectively pouring the beverage alone or the beverage and ice contained therein into a smaller drinking container, comprising:

a bottom wall defining a bottom plane for placement on a flat support surface;

at least one side wall upwardly dependent from said bottom wall terminating at an upper rim which defines an upper opening and an inner chamber;

an ice restricting spout formed radially outwardly from said side wall at said upper rim and having a restrictor to hold the ice back and keep the ice from exiting from said inner chamber while pouring the beverage;

an ice passing spout formed radially outwardly from said side wall at said upper rim and adapted to allow the ice as well as the beverage to exit simultaneously from within said inner chamber; and wherein there is a single cylindrical side wall upwardly dependent from said bottom wall, said bottom wall, said upper rim, and said upper opening being circular, and said inner chamber being cylindrical.

2. The multiple spout pitcher of claim 1, wherein the ice passing spout is larger and wider than the ice restricting spout.

3. The multiple spout pitcher of claim 1, additionally comprising a handle which extends radially outwardly from the side wall to facilitate picking up the pitcher by hand.

4. The multiple spout pitcher of claim 3, wherein the bottom wall, the side wall, and the handle are integrally molded together.

5. The multiple spout pitcher of claim 3, wherein the handle is of a vertically elongate U-shape extending longitudinally along the side wall.

6. The multiple spout pitcher of claim 3, wherein the ice restricting spout is disposed diametrically opposite the handle, and the ice passing spout is disposed about ninety-degrees to the handle.

7. The multiple spout pitcher of claim 6, wherein the ice passing spout is disposed to the left of the handle as held in-hand.

8. The multiple spout pitcher of claim 6, wherein the ice passing spout is disposed to the right of the handle as held in-hand.

9. The multiple spout pitcher of claim 1, wherein the ice passing spout and the ice restricting spout are each of an upwardly open, rounded V-shaped cross-section.

10. The multiple spout pitcher of claim 1, wherein the restrictor comprises at least one inwardly extending restrictor flap.

11. The multiple spout pitcher of claim 10, wherein there are a pair of oppositely disposed, inwardly extending restrictor flaps.

12. The multiple spout pitcher of claim 10, wherein the restrictor flap extends inwardly at an upward angle.

13. The multiple spout pitcher of claim 1, wherein the bottom wall is substantially flat, and the side wall is upwardly dependent from an outer periphery of said bottom wall.

14. The multiple spout pitcher of claim 1, additionally comprising a second ice passing spout disposed diametrically opposite the ice passing spout.

15. The multiple spout pitcher of claim 14, wherein the ice passing spouts are respectively disposed about ninety-degrees to the left and right of the ice restricting spout.

16. The multiple spout pitcher of claim 1, additionally comprising:

a handle which extends radially outwardly from the side wall to facilitate picking up the pitcher by hand; and wherein the ice restricting spout is disposed diametrically opposite said handle, the ice passing spout is disposed about ninety-degrees to said handle, said ice passing spout is larger and wider than said ice restricting spout, said ice passing spout and the ice restricting spout are each of an upwardly open, rounded V-shaped cross-section, and the restrictor comprises a pair of oppositely disposed, inwardly extending restrictor flaps which extend inwardly at an upward angle.

17. The multiple spout pitcher of claim 16, additionally comprising:

a second ice passing spout disposed diametrically opposite the ice passing spout; and wherein said ice passing spouts are respectively disposed about ninety-degrees to the left and right of the handle.

18. A multiple spout pitcher for containing a beverage and ice floating in the beverage which allows selectively pouring the beverage alone or the beverage and ice contained therein into a smaller drinking container, comprising:

a bottom wall defining a bottom plane for placement on a flat support surface;

at least one side wall upwardly dependent from said bottom wall terminating at an upper rim which defines an upper opening and an inner chamber;

a handle which extends radially outwardly from the side wall to facilitate picking up the pitcher by hand;

an ice restricting spout formed radially outwardly from said side wall at said upper rim diametrically opposite the handle, and having a restrictor to hold the ice back and keep the ice from exiting from said inner chamber while pouring the beverage;

an ice passing spout formed radially outwardly from said side wall at said upper rim disposed about ninety-degrees to the handle, and adapted to allow the ice as well as the beverage to exit simultaneously from within said inner chamber; and a second ice passing spout disposed diametrically opposite said ice passing spout, said ice passing spouts being respectively disposed about ninety-degrees to the left and right of said handle, and wherein there is a single cylindrical side wall upwardly dependent from said bottom wall, said bottom wall, said upper rim, and said upper opening being circular, and said inner chamber being cylindrical.

19. The multiple spout pitcher of claim 18, wherein the ice passing spout and the ice restricting spouts are each of an upwardly open, rounded V-shaped cross-section, and the restrictor comprises a pair of oppositely disposed, inwardly extending restrictor flaps which extend inwardly at an upward angle.

20. A multiple spout pitcher for containing a beverage and ice floating in the beverage which allows selectively pouring the beverage alone or the beverage and ice contained therein into a smaller drinking container, comprising:

a bottom wall defining a bottom plane for placement on a flat support surface;

at least one side wall upwardly dependent from said bottom wall terminating at an upper rim which defines an upper opening and an inner chamber;

an ice restricting spout formed radially outwardly from said side wall at said upper rim and having a restrictor comprising at least one inwardly extending restrictor flap to hold the ice back and keep the ice from exiting from said inner chamber while pouring the beverage;

an ice passing spout formed radially outwardly from said side wall at said upper rim and adapted to allow the ice as well as the beverage to exit simultaneously from within said inner chamber; and wherein said ice passing spout and said ice restricting spout are each of an upwardly open, rounded V-shaped cross-section, and wherein there is a single cylindrical side wall upwardly dependent from said bottom wall, said bottom wall, said upper rim, and said upper opening being circular, and said inner chamber being cylindrical.

21. The multiple spout pitcher of claim 20, additionally comprising a second ice passing spout disposed diametrically opposite the ice passing spout.

22. The multiple spout pitcher of claim 21, wherein the ice passing spouts are respectively disposed about ninety-degrees to the left and right of the ice restricting spout.

* * * * *